US008784177B2

(12) United States Patent
Lyons et al.

(10) Patent No.: US 8,784,177 B2
(45) **Date of Patent: *Jul. 22, 2014**

(54) GAMING SYSTEM AND A METHOD OF GAMING

(71) Applicants: Martin Stephen Lyons, Baconsfield (AU); Robert Linley Muir, Artarmon (AU)

(72) Inventors: Martin Stephen Lyons, Baconsfield (AU); Robert Linley Muir, Artarmon (AU)

(73) Assignee: Aristocrat Technologies Australia Pty Limited (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/850,161

(22) Filed: Mar. 25, 2013

(65) Prior Publication Data

US 2013/0288771 A1 Oct. 31, 2013

Related U.S. Application Data

(63) Continuation of application No. 12/163,756, filed on Jun. 27, 2008, now Pat. No. 8,425,301.

(30) Foreign Application Priority Data

Jun. 28, 2007 (AU) ..... 2007903480

(51) Int. Cl.
*G07F 17/32* (2006.01)

(52) U.S. Cl.
USPC ..... 463/16; 463/20; 463/25

(58) Field of Classification Search
USPC ..... 463/16, 20, 25, 29
IPC ..... G07F 17/32
See application file for complete search history.

(56) References Cited

U.S. PATENT DOCUMENTS

| | | | |
|---|---|---|---|
| 5,342,049 | A | 8/1994 | Wichinsky et al. |
| 5,785,593 | A | 7/1998 | Wood et al. |
| 6,270,412 | B1 | 8/2001 | Crawford et al. |
| 2002/0198036 | A1 | 12/2002 | Baerlocher et al. |
| 2006/0058097 | A1 | 3/2006 | Berman et al. |
| 2009/0048013 | A1 | 2/2009 | Castellari |

FOREIGN PATENT DOCUMENTS

| | | | |
|---|---|---|---|
| AU | 780806 | B2 | 5/2001 |
| AU | 2007201439 | A1 | 10/2007 |
| GB | 1233081 | | 6/1968 |
| WO | 0020082 | | 4/2000 |

*Primary Examiner* — Omkar Deodhar
(74) *Attorney, Agent, or Firm* — McAndrews, Held & Malloy, Ltd.

(57) ABSTRACT

The present invention relates to a gaming system and to a method of gaming. A gaming system comprises a game controller arranged to randomly display several symbols from a predetermined set of symbols and to determine a game outcome such as a game win based on the displayed symbols. Such gaming systems may be implemented as a stepper machine provided with reels or a video machine displaying "virtual" reels. One or more reels generated in play of a base game may be stored for later use in subsequent games. In a subsequent game or games, the game controller may select the stored reel to substitute for a reel generated by the game, in order to improve the game outcome. For example, the game outcome may become a "win" from a "lose" outcome. Or it may result in an improved win outcome. The one or more reels may be stored depending upon a trigger condition generated in the base game.

9 Claims, 10 Drawing Sheets

GAMING SYSTEM AND A METHOD OF GAMING

RELATED APPLICATIONS

This application claims priority to, and is a continuation of, U.S. patent application Ser. No. 12/163,756, filed Jun. 27, 2008, which also claims priority to Australian Provisional Patent Application No. 2007903480, having an international filing date of Jun. 28, 2007, entitled "A Gaming System And A Method Of Gaming," both of which are incorporated herein by reference in their entirety.

FEDERALLY SPONSORED RESEARCH OR DEVELOPMENT

[Not Applicable]

MICROFICHE/COPYRIGHT REFERENCE

[Not Applicable]

FIELD OF THE INVENTION

The present invention relates to a gaming system and to a method of gaming.

BACKGROUND OF THE INVENTION

It is known to provide a gaming system which comprises a game controller arranged to randomly display several symbols from a predetermined set of symbols and to determine a game outcome such as a game win based on the displayed symbols. Such gaming systems may commonly be implemented as a stepper machine provided with reels with each reel carrying several symbols of the set, or a video machine wherein selected symbols are displayed on virtual reels on a graphical display device. Win outcomes can occur based on symbols appearing in one or more horizontal lines, diagonal lines, or any other predetermined way. Typically five reels across are provided on the display (although less or more may be provided) and each reel or virtual reel display is three symbols high in the display window for the reel (although, again, this may be more or less symbols high).

It is known for gaming systems to enable selection (either by the game controller or by player input) of a reel to "hold" the reel so that it is available for subsequent game play. In the subsequent game play, the symbols for the remaining reels are selected and then the game outcome is determined in dependence on the symbols selected for the remaining reels and the symbols on the held reel.

While such gaming systems provide users with enjoyment, the need exists for alternative gaming systems in order to maintain or increase player enjoyment.

SUMMARY OF THE INVENTION

In accordance with a first aspect, the present invention provides a gaming system, comprising a symbol selector arranged to select a plurality of symbols from a set of symbols;

an outcome generator arranged to determine a game outcome based on the selected symbols;

a symbol store arranged to store one or more symbols, the outcome generator being arranged to determine whether or not to substitute one or more of the stored symbols for one or more of the selected symbols to determine a game outcome.

In an embodiment, the symbol selector is arranged to select the one or more symbols for storage in the symbol store from the plurality of symbols selected for a game.

In an embodiment, the outcome generator is responsive to a player input to determine whether or not to substitute one or more of the stored symbols.

In an embodiment, the outcome generator is arranged to make a determination whether a substitution of one or more of the stored symbols would improve the game outcome and, if so, the substitution is made. In an embodiment, the improved game outcome may be a win result.

In an embodiment, the one or more symbols are stored in the symbol store for a predetermined number of games, before being discarded. In an embodiment, the one or more symbols are stored in the symbol store until substituted by a further selection of symbols for storage.

In an embodiment, the symbol selector is arranged to select the one or more symbols for storage after a predetermined game outcome has occurred. The predetermined game outcome may be a trigger combination, triggering a selection of symbols for storage in the symbol store.

In an embodiment, the gaming system is arranged to display selected symbols in a display area. In an embodiment, the symbols may be displayed as a plurality of reels, either mechanical reels, implemented by stepper motor mechanism, or virtual reels which may be implemented by video or other technology. Following selection of symbols to display, the display may display each reel as a plurality of symbols appearing in a column. The number of symbols displayed may vary from embodiment to embodiment, and may be two, three or more symbols. In an embodiment, the symbol store is arranged to store a plurality of symbols which correspond to a game reel. The outcome generator may substitute the stored reel for one of the selected reels to determine a game outcome. A player may make an input selection to substitute a reel with the stored reel, or alternatively the outcome generator may automatically substitute a stored reel with a selected reel in order to affect the game outcome.

In accordance with a second aspect, the present invention provides a method of gaming, comprising the steps of selecting a plurality of symbols from a set of symbols, storing one or more symbols, and determining whether or not to substitute one or more of the stored symbols for one or more of the selected symbols to determine a game outcome.

In accordance with a third aspect, the present invention provides a computer program comprising instructions for controlling a computer to implement a gaming system in accordance with the first aspect of the invention.

In accordance with a fourth aspect, the present invention provides a computer readable medium providing a computer program in accordance with the third aspect of the invention.

In accordance with a fifth aspect, the present invention provides a data signal comprising a computer program in accordance with the third aspect of the invention.

BRIEF DESCRIPTION OF THE DRAWINGS

Features and advantages of the present invention will become apparent from the following description of embodiments thereof, by way of example only, with reference to the accompanying drawings, in which.

DETAILED DESCRIPTION OF EMBODIMENTS

Figure 1:
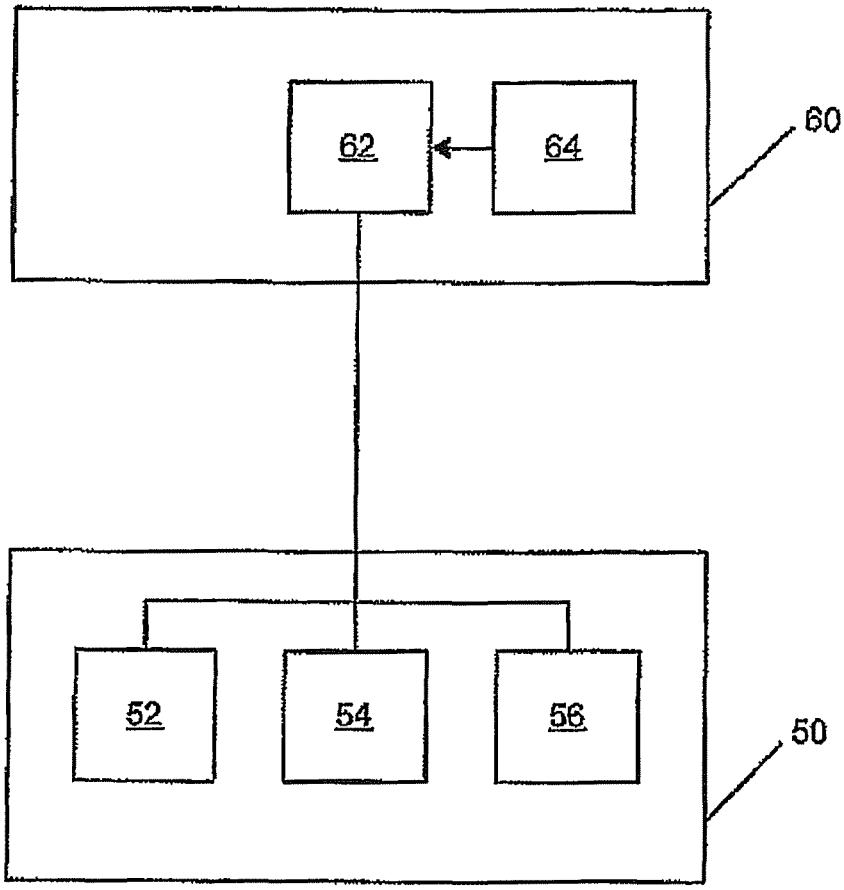
FIG. 1 is a schematic block diagram of core components of a gaming system in accordance with an embodiment of the present invention.

Referring to the drawings, there are shown example embodiments of gaming systems which are arranged to implement a game in which a plurality of symbols are selected from a set of symbols in order to determine a game outcome. In these embodiments, one or more symbols are arranged to be stored and may be substituted for one or more of the selected symbols in order to affect the game outcome. In one example, the gaming system is arranged to control a plurality of actual or virtual reels, the selected symbols being displayed in a display area showing a portion of each reel (e.g. three symbols high). In this example, enough symbols are stored to substitute for a displayed reel e.g. if the displayed reel is three symbols high, then at least three symbols are stored for substitution of a displayed reel. The stored symbols can be considered equivalent to storing a reel.

The stored reel may be substituted for a displayed reel automatically, for example if the system calculates that the reel substitution would improve the result for the player. A further option is for a player to determine that reel substitution should be made and issue a reel substitution command via a player interface.

In embodiments, a reel may only be stored when a predetermined game outcome has been achieved.

For example, a particular combination of symbols appearing on the display may operate as a trigger which causes the gaming system to store a reel. A reel may be stored until it is used or may be stored for a finite number of game plays.

The gaming system of this embodiment of the invention can take a number of different forms.

In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system comprises several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions and play the game.

Components of the player interface may vary from embodiment to embodiment but will typically include a credit mechanism 52 to enable a player to input credits and receive payouts, one or more displays 54 and a game play mechanism 56 that enables a player to input game play instructions.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
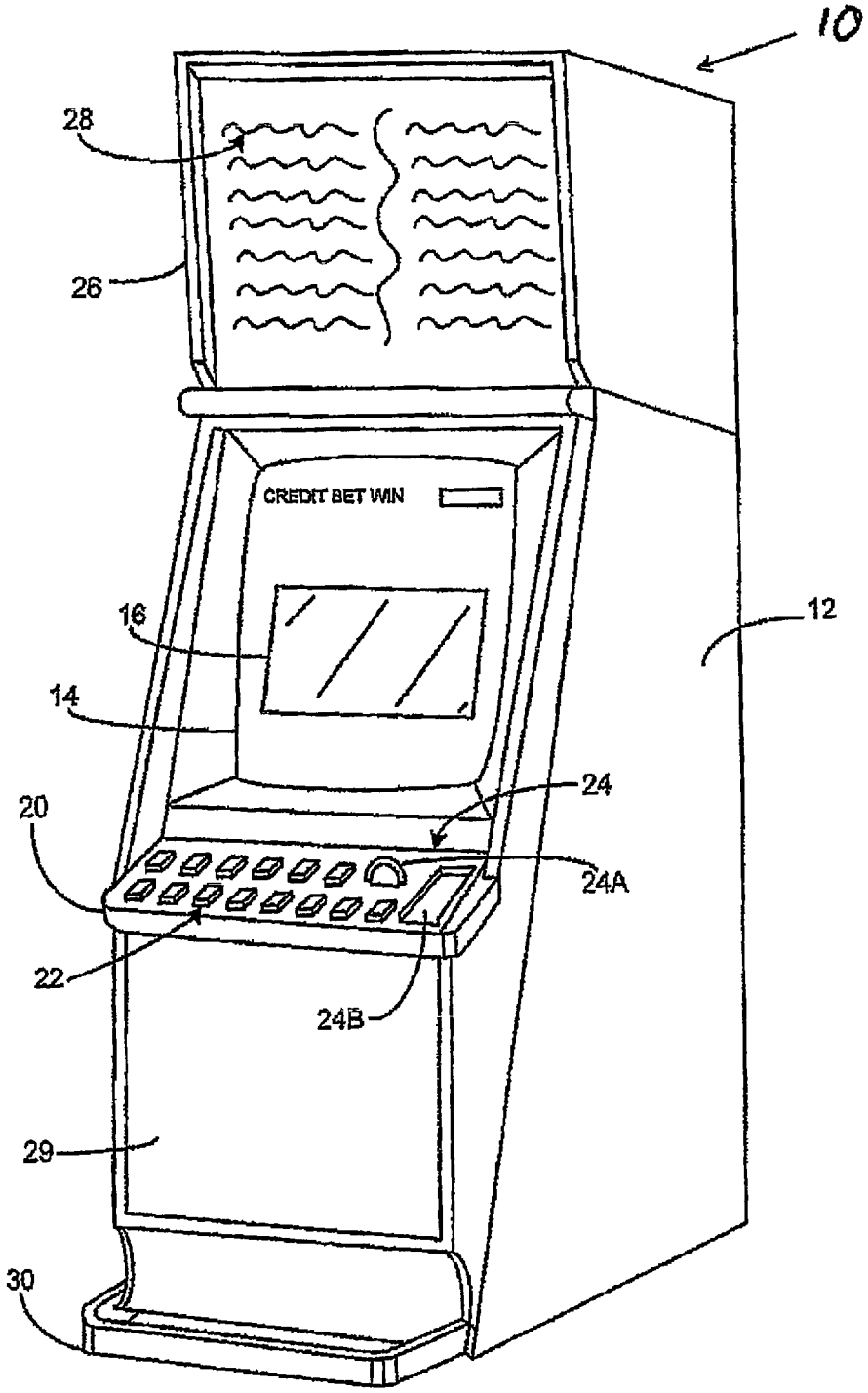
FIG. 2 is a diagrammatic representation of a gaming system in accordance with an embodiment of the present invention with the gaming system implemented in the form of a stand alone gaming machine.

A gaming system in the form of a stand alone gaming machine 10 is illustrated in FIG. 2. The gaming machine 10 includes a console 12 having a display 14 on which is displayed representations of a game 16 that can be played by a player. A mid-trim 20 of the gaming machine 10 houses a bank of buttons 22 for enabling a player to interact with the gaming machine, in particular during gameplay. The mid-trim 20 also houses a credit input mechanism 24 which in this example includes a coin input chute 24A and a bill collector 24B. Other credit input mechanisms may also be employed, for example, a card reader for reading a smart card, debit card or credit card. A reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 may be mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
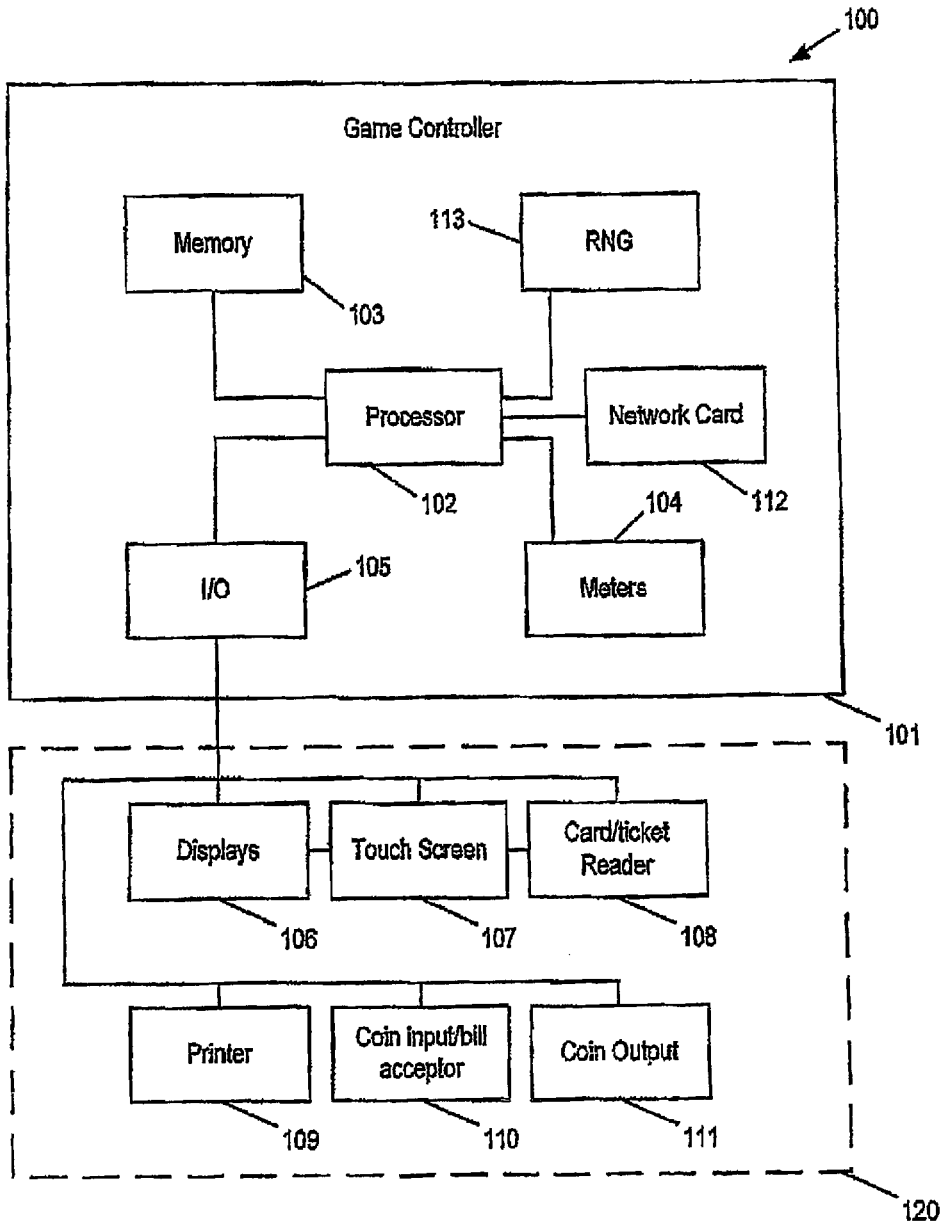
FIG. 3 is a schematic block diagram of operative components of the gaming machine shown in FIG. 2.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 comprise one or more displays 106, a touch screen 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

Figure 4:
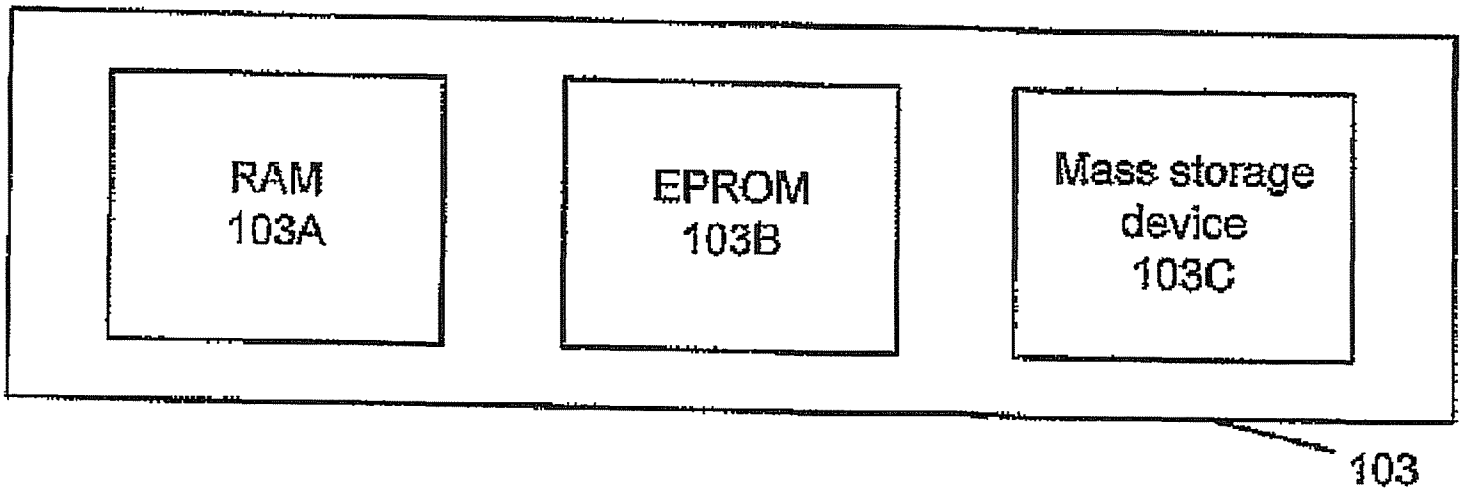
FIG. 4 is a schematic block diagram of components of a memory of the gaming machine shown in FIG. 2.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106, 107, 108, 109, 110, 111 to be provided remotely from the game controller 101.

Figure 5:
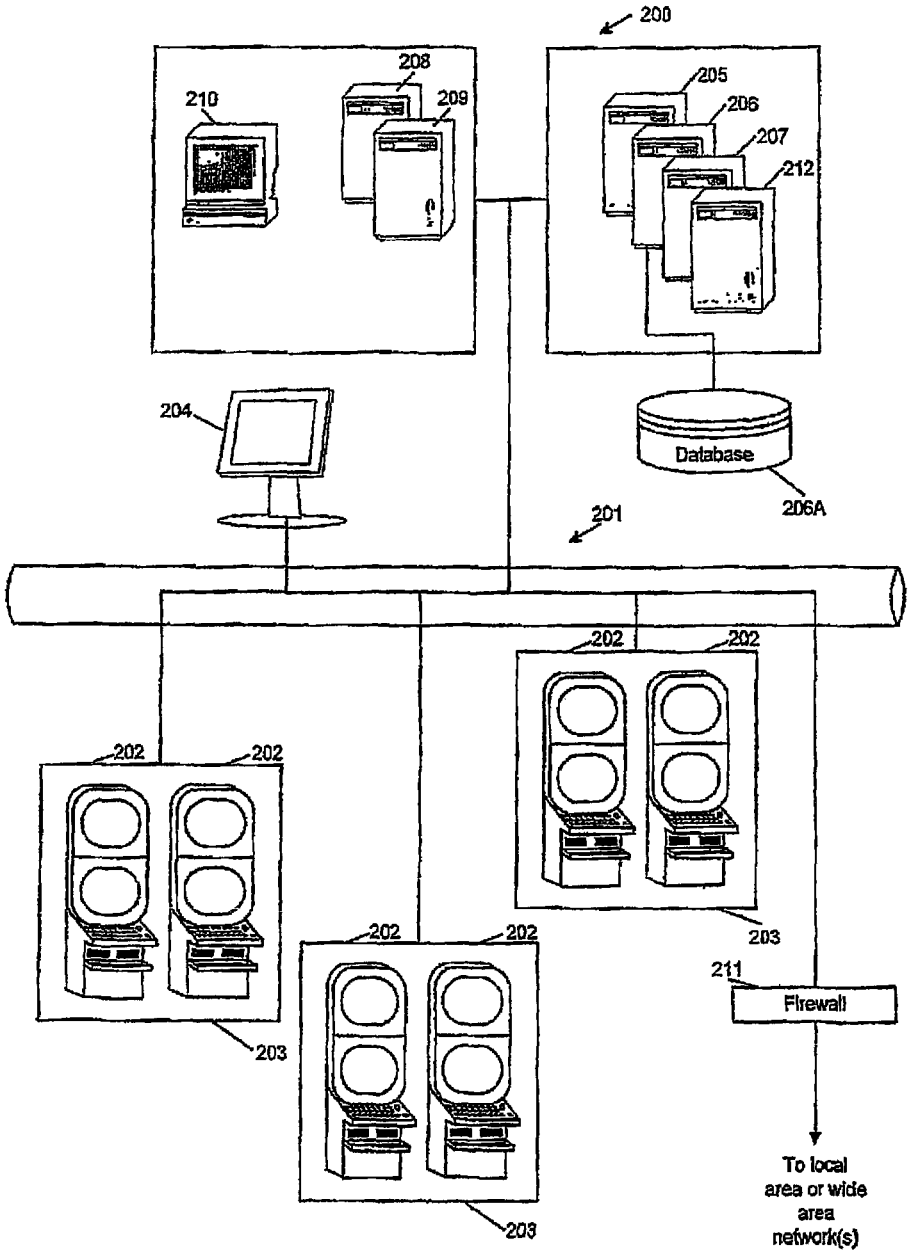
FIG. 5 is a schematic diagram of a gaming system in accordance with an alternative embodiment of the present invention with the gaming system implemented over a network.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10, 100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming network 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Figure 6:
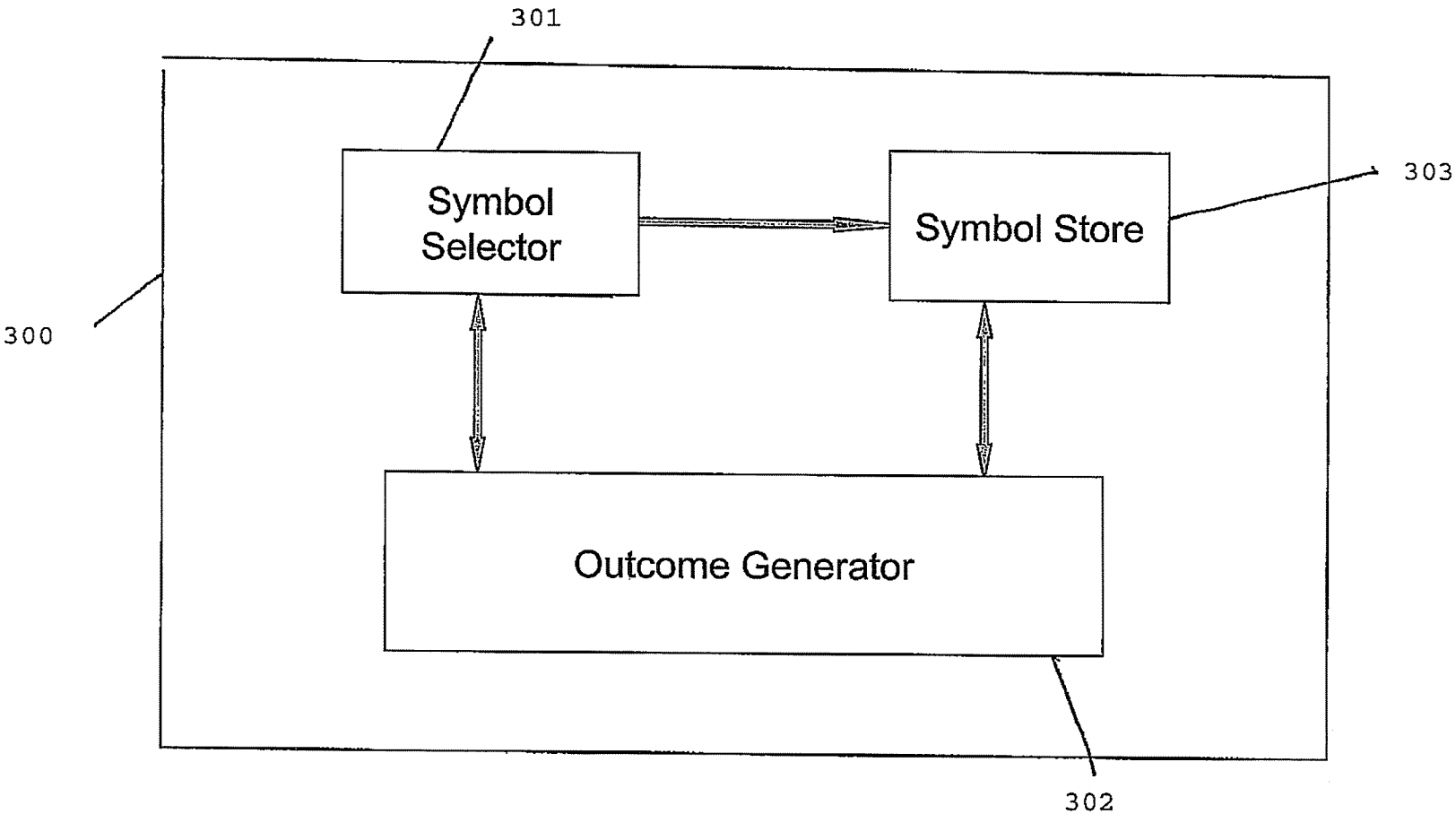
FIG. 6 is a schematic diagram of functional components of a gaming system in accordance with an embodiment of the present invention.

Referring to FIG. 6, the functionality of embodiments of the present invention may be implemented by a game controller having the functional components illustrated. In these embodiments, the functional components are implemented utilizing a processor and memory, (such as processor 102 and memory 103 in FIG. 3, or processor 62 and memory 64 in FIG. 1, or the game server 205 of FIG. 5) and associated programming. Other implementations are envisaged. For example, the functional blocks of FIG. 6 may be implemented in hardware as separate units, or a combination of hardware and software as separate units. Any practical implementation of these functional units may be employed.

Referring to FIG. 6, a game controller 300 includes a symbol selector 301 which is arranged to select a plurality of symbols from a set of symbols. Selection is determined by generated random numbers (e.g. generated by random number generator module 113 or similar). In the normal course of a game, these symbols are displayed on the display (54 of FIG. 1, 16 of FIG. 2, 106 of FIGS. 3 and 204 of FIG. 5). The selected symbols in this embodiment are displayed as a plurality of virtual reels on a video display. Alternatively, the display may comprise a stepper motor and physical reels.

The game controller 300 also includes an outcome generator 302 which is arranged to determine an outcome of the game. In this embodiment, the outcome of the game depends on the selected symbols and may include a win outcome, loss outcome, a trigger outcome or a feature outcome. Outcomes may be determined on the basis of symbols appearing in one or more horizontal lines, diagonal lines, or any other predetermined combination.

In this embodiment, the game controller 300 also comprises a symbol store 303. The symbol store is arranged to store one or more symbols which are selected for store by the outcome generator, from the symbols initially selected by the symbol selector 301 to play the game. In this embodiment, the symbols stored in the symbol store 303 include enough symbols to represent at least one reel. The reel is stored for use in a later game. In the later game, the outcome generator 302 may determine that it would be useful to substitute the reel stored in the symbol store 303 with one of the reels selected by the symbol selector 301, in order to affect the game outcome. The "at least one reel" stored includes enough symbols to represent the visible part of the reel as displayed by the display. This may be three symbols (where the visible part of the reel is three symbols high), for example. It may be more or fewer symbols than this. In embodiments which allow the stored reel to be "nudged" once it has been placed back in the display (see later), then more than the visible number of symbols may be stored as the stored reel, to allow for further symbols to be displayed when the reel is nudged.

An example of game play utilizing this embodiment of the present invention will now be described with reference to FIGS. 7 and 8.

FIG. 7 shows a schematic representation of a gaming machine display 400 which, in the example shown, has five reels (numbered "1" to "5"). The display window 401 shows three reel positions high when the reels have stopped/the symbols have been selected. The reel positions are designated Bottom ("B"), Center ("C") and Top ("T"). This is a typical reel-type display for a gaming machine. It will be appreciated that in other embodiments the number of reel positions may be more or less than in display 400. Also the number of reels may be more or less than in the display 100.

The reels may be virtual reels, generated as a video display from the selected symbols, actual mechanical reels carrying the symbols and driven by a stepper motor, or any other reel arrangement or emulation. In the case of actual physical reels, the game controller drives a stepper motor to randomly select the symbols appearing in the display 400.

The game outcome is determined by the outcome generator based on combinations of symbols selected and appearing in the display 400. The symbols may be any symbols. As will be appreciated, many different types of symbols are used in gaming systems. A set of symbols may include standard symbols and function symbols. For example, standard symbols may resemble fruit such as apples, pears and bananas with a win outcome being determined when a predetermined number of the same fruit appear on a display in the same line, scattered, and so on. The function associated with a function symbol may be a "wild" function wherein display of the function symbol is treated during consideration of the game outcome as any of the standard symbols. Other functions may include scatter functions, multiplier functions, repeat win functions, jackpot functions and feature commencement functions.

Figure 7A:
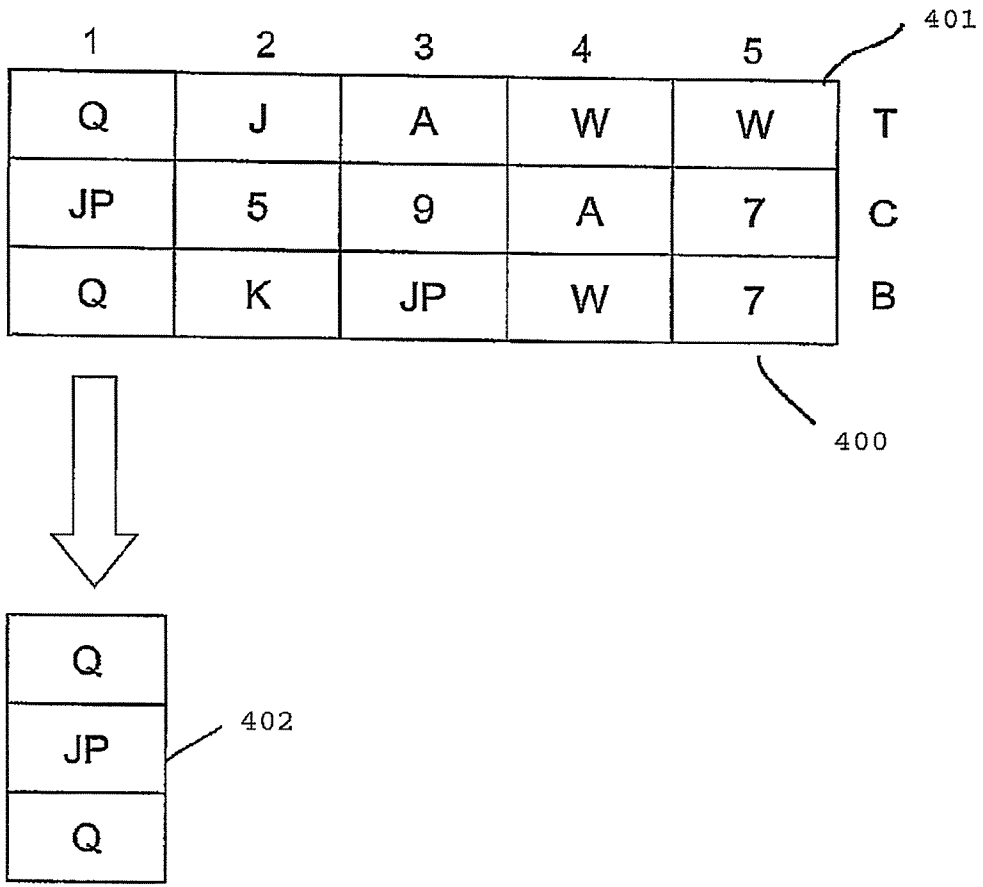
FIGS. 7*a* through 7*c* are representations of example displays generated by a gaming system in accordance with an embodiment of the present invention.

In the example shown in FIG. 7*a*, the symbols are representations of cards, by which a poker-type card game may be played. In this example, a winning poker hand appearing on the C line may cause the outcome generator to determine that a Win has occurred and that an appropriate prize may be allocated. For example, five of a kind (e.g. 5 jacks "J", 5 tens "10" etc.) on the C line may result in a win. A straight or a straight flush or any other poker combination in the C line may also result in a win. In this example, therefore, a win can only occur on the C line. It will be appreciated that in other embodiments, there may be more and even many more than a single win line.

In addition to card symbols, the symbols also include a Wild ("W") symbol which is a function symbol which, when it occurs on the C line may be considered by the outcome generator 302 to operate as any symbol which may assist in a win. Symbols also include a Jackpot ("JP") symbol which when five JP symbols appear on the C line may result in a jackpot win. The jackpot may be a progressive jackpot, a linked progressive jackpot, or any other type of jackpot.

The diagrams shown in FIG. 7*a* are schematic only and it will be appreciated that embodiments of the invention may implement the symbols graphically with fancy artwork or in any other appropriate manner.

Figure 7B:
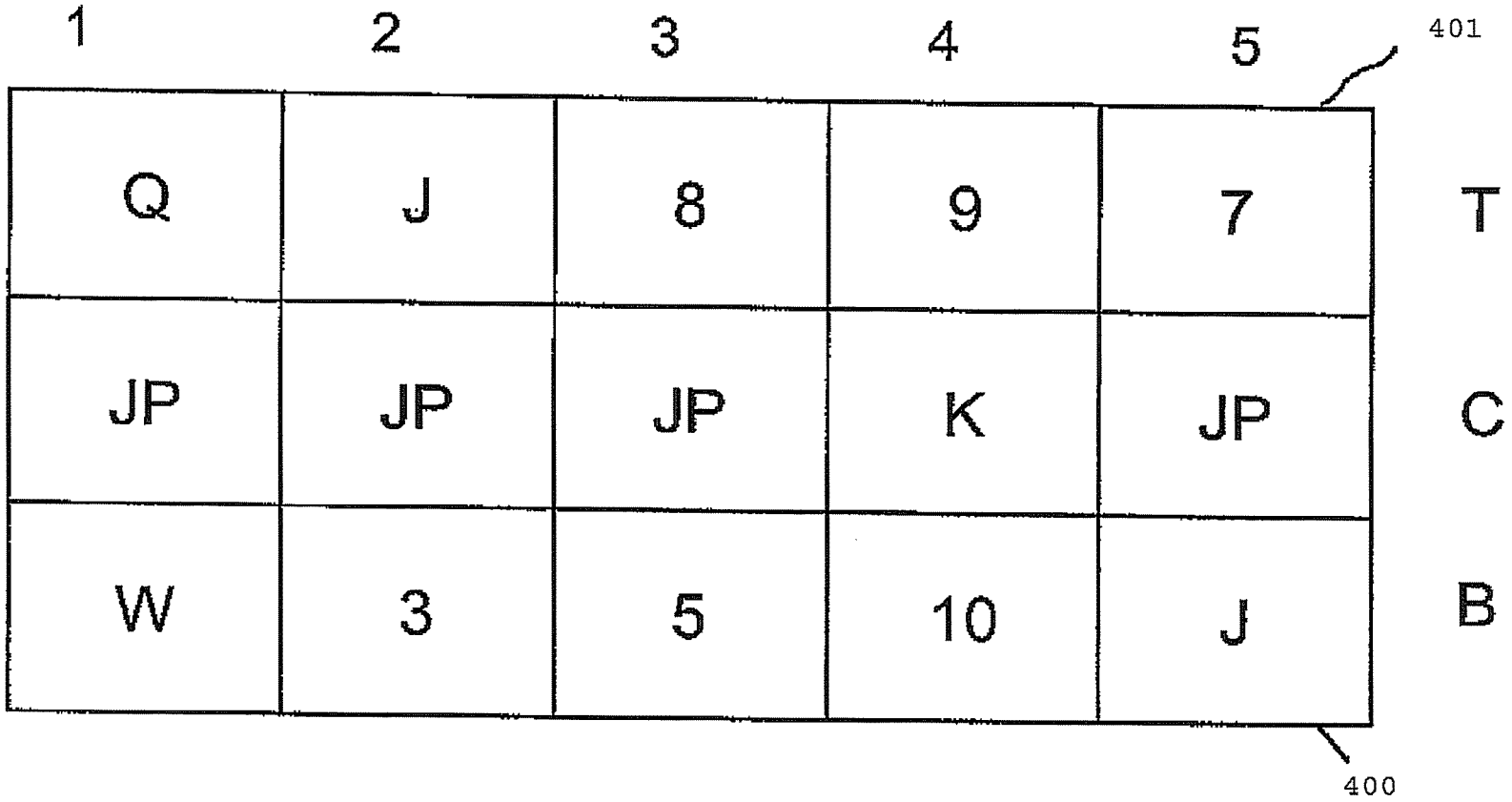
Figure 7C:
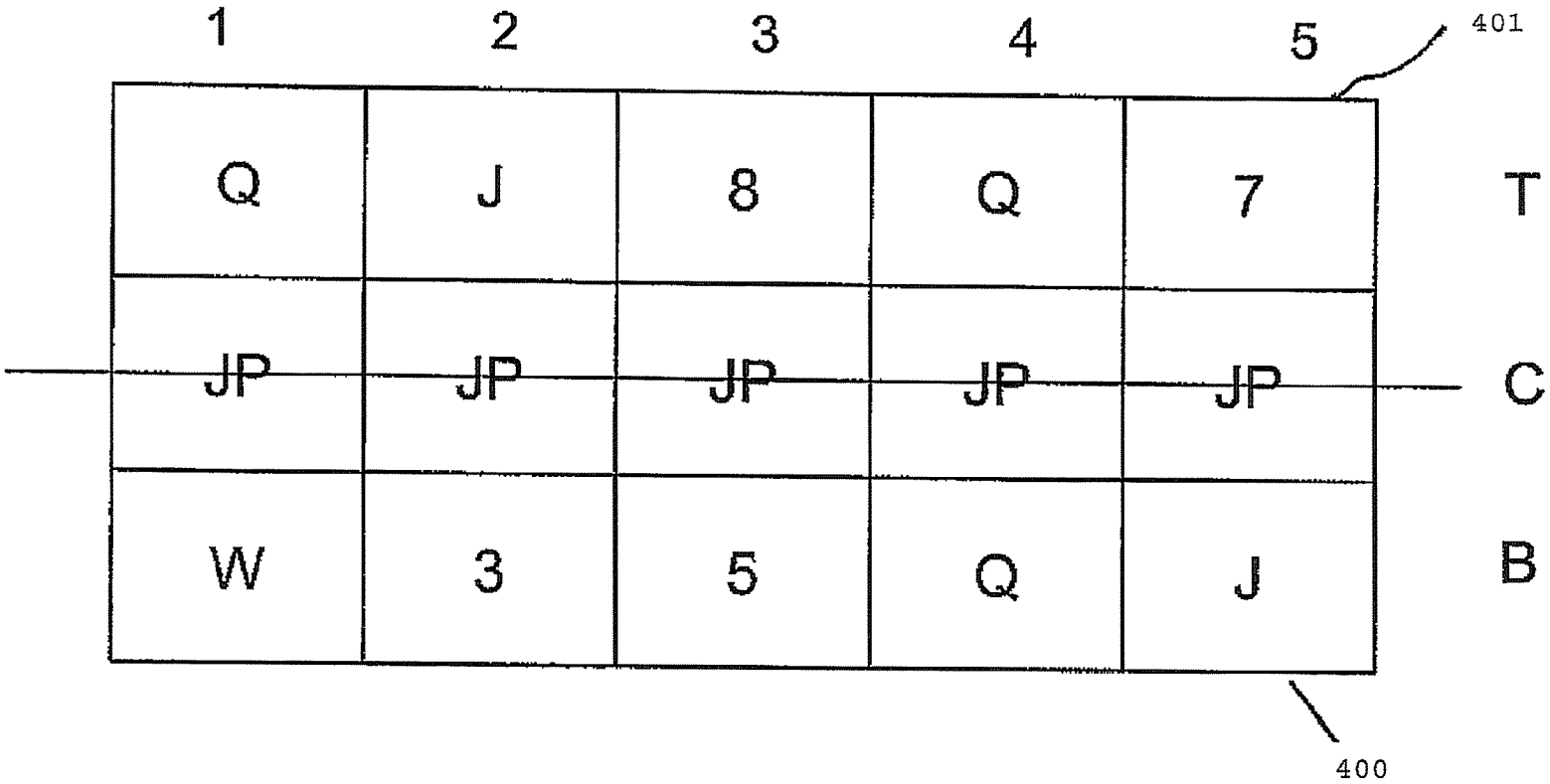
Figure 8:
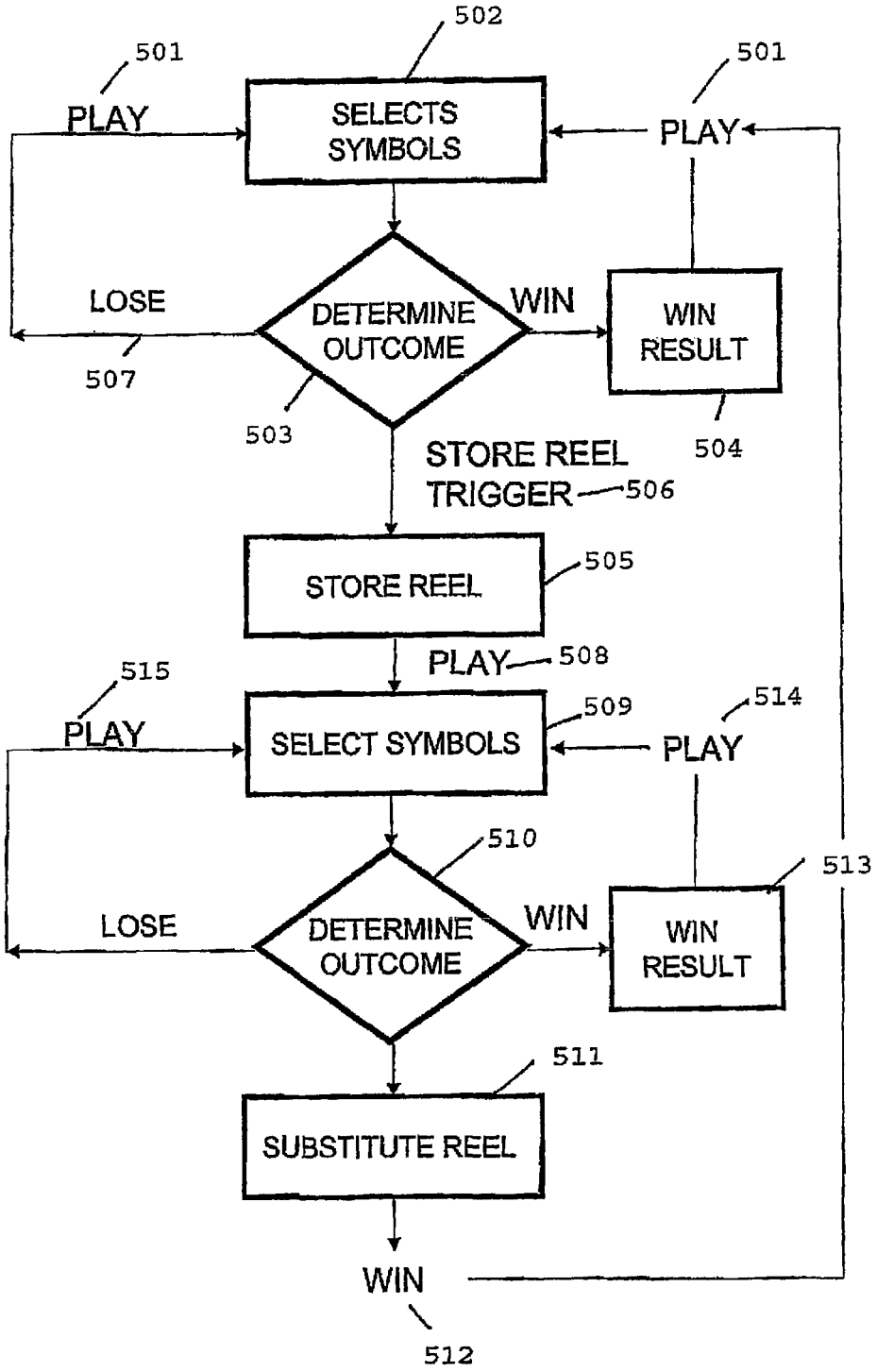
FIG. 8 is a flow diagram illustrating operation of a gaming system in accordance with an embodiment of the present invention.

Referring to FIGS. 7 and 8, in a first step a player will input credit or will have credit available on a machine and may actuate the gaming system interface to instigate a Play, reference numeral 501. The symbol selector 301 then operates to select symbols (reference numeral 502) which appear on the display 400. The outcome generator 302 operates to determine a game outcome (step 503). In this example, the C line is not a winning line. No Win Result (step 504) is determined, therefore.

A JP symbol does appear in column 1 of line C, however. In accordance with the game instructions for this game stored in the memory, the outcome generator 302 determines an outcome of Store Reel (step 505) on the basis that a JP appearing in a C line of a reel results in a Store Reel Trigger resulting in the reel being selected to be stored in the symbol store 303. Reel 1 of screen 400 is therefore stored (reference numeral 403, FIG. 7*a*). If no Store Reel Trigger (reference numeral 506) is determined, then a Lose (reference numeral 507) is determined and the player may choose to play a further game (501).

In this example, the JP on the C line triggers a store reel 505 step. Other symbols or combinations of symbols in a reel may trigger a Store Reel step. A particular combination on one of the lines may trigger a Store Reel step, also. It is also an option to have a player input which allows a player to select a reel for storing, so that the outcome generator 302 is arranged to store the reel based on player input, i.e. player input is the Store Reel Trigger 506.

With reel 402 stored in our example, the next step is a further play 508. In this embodiment, the further play requires player credit and player input. In other embodiments, however, play may occur automatically, such as a feature game being played when the Store Reel step 505 occurs.

At step 509, the symbol selector 301 selects a new set of symbols for display in the window 400. Referring to FIG. 7*b*, in our example it can be seen that the C line includes JP symbols at reel positions 1, 2, 3 and 5. There is a king ("K") symbol at reel position 4, however. At step 510 an outcome is determined. In this case the outcome generator will determine that there is no win, but is arranged to automatically look at whether the stored reel 402 would change the outcome favourably. In this case it does change the outcome favourably and at step 511 the reel 402 is automatically substituted at position 4 to give the display shown in FIG. 7*c*. The Substitute Reel step event 511 results in a winning C line of five JP symbols, and a win (Jackpot) outcome is determined (reference numeral 512). In this embodiment, the stored reel is then cancelled and normal play 501 is resumed if the player wishes to play further games. In other embodiments, the stored reel may be saved for further game plays.

If at the determine outcome step 510 a win occurs without the substitute reel, then a win result is determined at 513 and the player may play a game at 514, with the stored reel being retained in the symbol store 303.

If at step 510 the determined outcome is a lose and a substitution of the reel would not improve the play position, then the stored reel may be retained in the symbol store 303 and the player may play again at 515.

As an alternative or in addition to the outcome generator 302 automatically determining whether or not a reel should be substituted, a player may determine that the reel should be substituted and manipulate the player interface to cause the outcome generator to substitute the reel. Even where a win occurs, a reel may still be stored. That is, a player may have a win outcome at step 504, and a determination may still be made to store a reel at 505 for later play. Both a win and a store reel event may occur as a result of steps 503, 504, 510, and 513. At step 510, for example, a determination may be made to store a further reel, if a "good" a reel is available, or to replace the already stored reel with a new stored reel. In another alternative, a win outcome may be determined, and then a further win may be provided by substituting the stored reel. The player may therefore obtain two win outcomes, one from the base game and the other from the base game plus the stored reel.

It will be appreciated there are many variations on how a stored set of symbols could be utilized to substitute for symbols to affect a game outcome.

In one variation, more than one reel may be stored. For example, two or three reels may be stored (or more). The number of stored reels will depend upon the probability of winning and return to player.

In another variation a single stored reel may be stored for use in any reel position (as with the FIG. 7*a* example above) or may be limited to being used only in the reel position that it originally came from.

Storing of a reel may be based on a trigger, a feature game or may be based on selection by a player or any other trigger event. A stored reel may be stored merely because the outcome generator or player calculate that it may be useful later on in a future game.

A reel may be stored for a predetermined number of game plays and then dispensed with. For example it may be stored for ten game plays and then dispensed with if not utilized. Alternatively, it may be stored until utilized. Alternatively, a player may have the choice as to whether or not to dispense with the stored reel and, for example, replace it with a further reel for store. A stored reel may be utilized more than once by substitution in the main display. Or it may be only utilized once and then dispensed with.

A new reel may be automatically stored only when it is better than the already stored reel. That is, it may contain more favorable symbols.

In an embodiment, a stored reel may be "nudged" when substituted. That is, the reel may be moved upwards or downwards to move a symbol into a winning line, for example. More than the number of symbols that appear in a reel may be stored in this circumstance, so that symbols are available to appear in the window on nudging. This is not essential, however.

In an embodiment, the stored reel may be used for a number of games. That is, it may be used to determine a win result for more than one game and retained in store to be used for other games.

In an embodiment, a sequence of games may be played and at the end of the sequence, all or a subset of the sequence may be replayed, and improvements (i.e. substituting one or more stored reels) applied to the games. The improvements may be applied to the most beneficial games, for example. A further display may be provided, which may be separate from the main game display, and which may be arranged to show how a win might occur if the substitute reel is applied to that game. For example, there may be two stored reels, that can be used once each only, in ten games played as "free games" in a feature. During the initial pass through all of the ten games, there may be five games which could be improved, and all five would show both the win (or loss) without improvement. On replay, only the two games that are selected for improvement are shown. This embodiment need not be played as a feature, but could be played as a base game. There may be any number of games that could be played before being replayed.

In an embodiment, the stored reel may be available for viewing on a display on the gaming system, so that the player is aware of the contents of the stored reel. The display may be in a different display area than the main display, or may be adjacent to the main display or part of the main display in a separate section. In an alternative embodiment, the stored reel may not be visible to the player, but may be stored in memory.

Where the stored reel(s) are displayed, a secondary display displaying the stored reel may be implemented as a video display or a stepper display. On a secondary stepper display, for example, there may be one or more reels and part of each of the reels shows blanks (at least three symbols high on a three symbol high window). When a reel is stored one of the secondary stepper reels rotates to the correct position, and when the stored reel is deleted or used the secondary reel rotates to show nothing (or some other non stored reel artwork).

In the above embodiment, the stored reel is selected from one of the reels selected for a game. In an alternative embodiment, the player may build a reel to be stored for use in later games, by selecting symbols for the stored reel.

In an embodiment, a player may "purchase" one or more stored reels. For example, they may input extra credit, as an ante-bet. Then they have the option to get stored reels. The number of stored reels they can get may also depend on the bet.

In the above embodiment, the selected reels are displayed before stored reel substitution occurs. In an alternative embodiment, the game controller may automatically substitute the stored reel before a display of any of the reels occurs.

In another embodiment, reels may not be stored, but one or more symbols may be stored for substitution at any part of a selected symbol display.

In the above described embodiments, the display emulates a plurality of reels. In an alternative embodiment, the display may not emulate reels but merely show graphical representations of symbols in a non-reel formal e.g. presented in a series of rows and columns. For the purposes of this embodiment, a "stored reel" is considered as a column of selected symbols. The term "stored reel" as used in this specification should be read to also cover non-reel representations such as this.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Persons skilled in the art will appreciated that the method of the embodiment could be embodied in program code. The program code could be supplied in a number of ways, for example on a computer readable medium, such as a disc or a memory (for example, that could replace part of memory 103) or is a data signal (for example, by downloading it from a server).

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A gaming system for playing a first game and a second game, the system comprising:

a symbol selector configured to select a first plurality of subsets of symbols from a plurality of corresponding sets of symbols for the first game;

an outcome generator configured to 1) determine an outcome of the first game based on the selected subsets of symbols, and 2) select, without input from a player, at least one of said selected subsets of symbols to be stored;

a symbol store configured to store said at least one selected subsets of symbols in response to said first game outcome comprising at least one predefined symbol; and wherein said symbol selector is further configured to select a second plurality of subsets of symbols from said corresponding sets of symbols for the second game, and wherein said outcome generator is further configured to substitute said at least one selected subsets of symbols stored in the symbol store for at least one of said second subsets of symbols in response to said at least one selected subsets of symbols resulting in a more favourable win than said second subsets of symbols.

2. A gaming system in accordance with claim 1, further comprising a display configured to display said sets of symbols in a reel format having a plurality of reels, and wherein the stored said at least one selected subsets of symbols represents a stored reel.

3. A gaming system in accordance with claim 1, and wherein, when the outcome generator determines to substitute the stored at least one selected subsets of symbols for said at least one of said second subsets of symbols, symbols of the stored at least one selected subsets of symbols substitute corresponding symbols on said at least one of said second subsets of symbols.

4. A gaming system in accordance with claim 1, and wherein the outcome generator automatically determines whether or not to make a substitution with the stored at least one selected subsets of symbols.

5. A gaming system in accordance with claim 1, and wherein the outcome generator determines whether or not to make a substitution with the stored at least one selected subsets of symbols based on an input from a player.

6. A method of gaming for use with a gaming machine playing a first game and a second game, and having a controller, the method comprising selecting, via a controller, a first plurality of subsets of symbols from a plurality of corresponding sets of symbols for the first game;

determining, via said controller, an outcome of the first game based on the selected subsets of symbols;

selecting, via said controller, without input from a player, at least one of said selected subsets of symbols to be stored;

storing, via said controller, said at least one selected subsets of symbols in response to said first game outcome comprising at least one predefined symbol;

selecting, via said controller, a second plurality of subsets of symbols from said corresponding sets of symbols for the second game; and substituting, via said controller, said at least one selected subsets of symbols stored in the symbol store for at least one of said second subsets of symbols in response to said at least one selected subsets of symbols resulting in a more favourable win than said second subsets of symbols.

7. A method in accordance with claim 6, further comprising displaying the plurality of sets of symbols in a reel format and wherein storing said at least one selected subsets of symbols comprises storing said at least one selected subsets of symbols in a reel format.

8. A method in accordance with claim 7, and wherein determining whether to substitute, said at least one selected subsets of symbols further comprises determining if the substitution improves the second game outcome.

9. A method in accordance with claim 8, and wherein determining whether to substitute, said at least one selected subsets of symbols comprises receiving a player input.

* * * * *